US005769516A

United States Patent [19]

Aguilera

[11] Patent Number: 5,769,516

[45] Date of Patent: Jun. 23, 1998

[54] CABINET FOR DISPLAYING AND STORING COMPACT DISCS

[76] Inventor: Lorenzo H. Aguilera, 2539 Nebraska Ave., South Gate, Calif. 90280

[21] Appl. No.: 798,998

[22] Filed: Feb. 7, 1997

[51] Int. Cl.[6] ..... A47B 81/06

[52] U.S. Cl. ..... 312/321.5; 312/9.43; 312/324

[58] Field of Search ..... 312/9.41, 9.42, 312/9.43, 321.5, 324, 326, 117, 123, 130

[56] References Cited

U.S. PATENT DOCUMENTS

| | | | |
|---|---|---|---|
| 170,133 | 11/1875 | Vine et al. | 321/324 X |
| 850,210 | 4/1907 | Cady | 312/324 X |
| 1,071,760 | 9/1913 | Lanoue | 312/123 |
| 1,409,445 | 3/1922 | Hillyer et al. | 312/324 X |
| 1,543,980 | 6/1925 | Blood | 312/324 X |
| 2,465,555 | 3/1949 | Smith | 312/324 X |
| 3,078,133 | 2/1963 | Schauer | 312/321.5 |
| 3,481,485 | 12/1969 | Hess | 108/61 X |

FOREIGN PATENT DOCUMENTS

| | | | |
|---|---|---|---|
| 1059600 | 11/1953 | France | 312/324 |
| 222358 | 10/1924 | United Kingdom | 312/326 |
| 744992 | 2/1956 | United Kingdom | 312/324 |

*Primary Examiner*—Jose V. Chen
*Assistant Examiner*—Janet M. Wilkens

[57] ABSTRACT

A cabinet for displaying and storing compact discs. The cabinet includes a housing. The cabinet includes a pair of door compartments, a right door compartment and a left door compartment. Each of the door compartments has a front panel. The pair of door compartments are hingedly secured within an open front of the housing. Each of the door compartments includes a rear storage section.

1 Claim, 3 Drawing Sheets

CABINET FOR DISPLAYING AND STORING COMPACT DISCS

BACKGROUND OF THE INVENTION

1. Field of the Invention

The present invention relates to a cabinet for displaying and storing compact discs and more particularly pertains to storing and displaying compact discs for positioning within an entertainment center with a cabinet for displaying and storing compact discs.

2. Description of the Prior Art The use of storage cabinets is known in the prior art. More specifically, storage cabinets heretofore devised and utilized for the purpose of storing compact discs are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,383,722 to Chen discloses a drawer type CD-ROM storage cabinet.

U.S. Pat. No. 5,097,946 to Emrich discloses a storage unit for compact discs and the like.

U.S. Pat. No. Des. 334,852 to Beirise discloses the ornamental design for a storage cabinet.

U.S. Pat. No. 5,050,734 to Chen discloses a storage box.

U.S. Pat. No. 5,409,108 to Clausen et al. discloses a cartridge/cassette storage apparatus.

U.S. Pat. No. 5,310,054 to Stumpff et al. discloses a storage container for disk-shaped object.

While these devices fulfill their respective, particular objective and requirements, the aforementioned patents do not describe a cabinet for displaying and storing compact discs for storing and displaying compact discs for positioning within an entertainment center.

In this respect, the cabinet for displaying and storing compact discs according to the present invention substantially departs from the conventional concepts and designs of the prior art, and in doing so provides an apparatus primarily developed for the purpose of storing and displaying compact discs for positioning within an entertainment center.

Therefore, it can be appreciated that there exists a continuing need for new and improved cabinet for displaying and storing compact discs which can be used for storing and displaying compact discs for positioning within an entertainment center. In this regard, the present invention substantially fulfills this need.

SUMMARY OF THE INVENTION

In the view of the foregoing disadvantages inherent in the known types of storage cabinets now present in the prior art, the present invention provides an improved cabinet for displaying and storing compact discs. As such, the general purpose of th e present invention, which will be described subsequently in greater detail, is to provide a new and improved cabinet for displaying and storing compact discs and method which has all the advantages of the prior art and none of the disadvantages.

To attain this, the present invention essentially comprises a housing having a rectangular configuration. The housing has an open front, a rear wall, a top wall, a bottom wall, two opposed side walls and a hollow interior. The hollow interior is divided in to a front section and a rear section. The rear section has a shelf disposed therein between the two opposed side walls with a plurality of vertical dividers. The device includes a pair of door compartments including a right door compartment and a left door compartment. Each of the door compartments include a front panel. The pair of door compartments are hingedly secured within the open front of the housing. The front panel has a pair of windows therethrough. The front panel of the right door compartment has an interior panel integral with an inner edge thereof. The interior panel has a finger aperture therethrough disposed below the windows therethrough. Each of the door compartments include a rear storage section. The rear storage section is secured to an interior surface of the front panel. The rear storage section includes an upper wall, a lower wall, a rear wall, a rear panel and one side wall thereby defining an open side face. Further provided is an intermediate shelf disposed between the upper wall and the lower wall. The intermediate shelf is disposed between the pair of windows on the front panel. The open side faces each have a containment rod situated both above and below the intermediate shelf of the rear storage section, wherein at least one of the containment rods has at least one hook and loop patch secured thereto for securing a remote control thereto. Each of the pair of door compartments have a depth equal to a depth of the front section of the hollow interior of the housing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting, As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cabinet for displaying and storing compact discs which has all the advantages of the prior art storage cabinets and none of the disadvantages.

It is another object of the present invention to provide a new and improved cabinet for displaying and storing compact discs which may be easily and efficiently manufactured and marketed.

It is a further object of the present invention to provide a new and improved cabinet for displaying and storing compact discs which is of durable and reliable construction.

An even further object of the present invention is to provide a new and improved cabinet for displaying and storing compact discs which is susceptible of a low cost of manufacture with regard to both materials and labor, and which accordingly is then susceptible of low prices of sale to the consuming public, thereby making such a cabinet for displaying and storing compact discs economically available to the buying public.

Even still another object of the present invention is to provide a new and improved cabinet for displaying and storing compact discs for storing and displaying compact discs for positioning within an entertainment center.

Lastly, it is an object of the present invention to provide a new and improved cabinet for displaying and storing compact discs. The cabinet includes a housing. The cabinet includes a pair of door compartments, a right door compartment and a left door compartment. Each of the door compartments has a front panel. The pair of door compartments are hingedly secured within an open front of the housing. Each of the door compartments includes a rear storage section.

These together with other objects of the invention, along with the various features of novelty which characterize the invention, are pointed out with particularity in the claims annexed to and forming a part of this disclosure. For a better understanding of the invention, its operating advantages and the specificobjects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
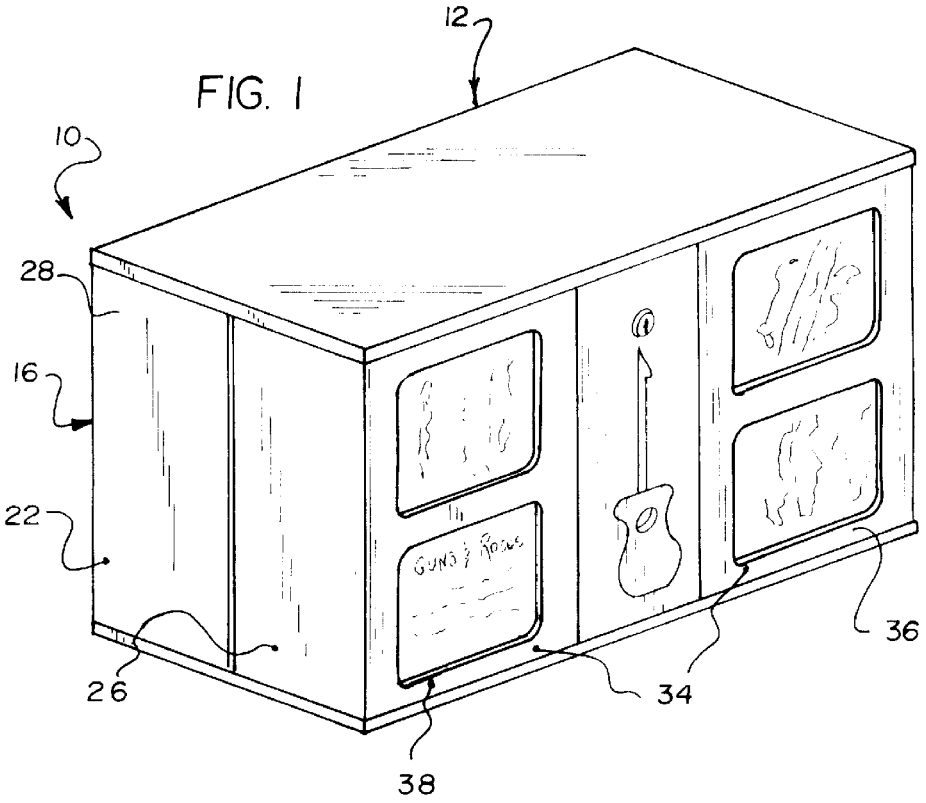
FIG. 1 is a perspective view of the preferred embodiment of the cabinet for displaying and storing compact discs constructed in accordance with the principles of the present invention.
Figure 2:
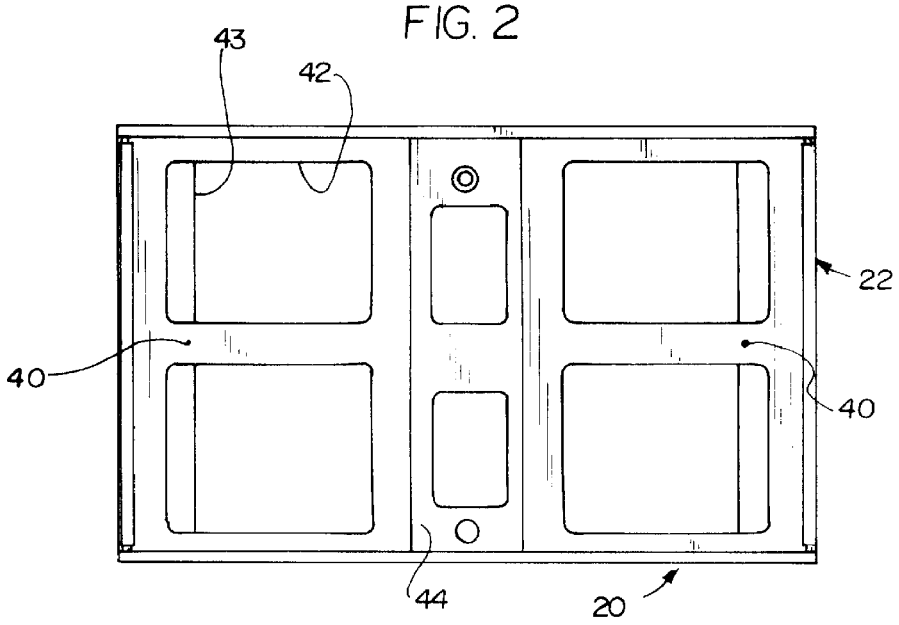
FIG. 2 is a front elevation view of an alternate embodiment of the present invention.

With reference now to the drawings, and in particular, to FIGS. 1 through 6 thereof, the preferred embodiment of the new and improved cabinet for displaying and storing compact discs embodying the principles and concepts of the present invention and generally designated by the reference number 10 will be described.

Specifically, it will be noted in the various Figures that the device relates to a cabinet for displaying and storing compact discs for storing and displaying compact discs for positioning within an entertainment center. In its broadest context, the device consists of a housing and a pair of door compartments. Such components are individually configured and correlated with respect to each other so as to attain the desired objective.

The device 10 includes a housing 12 having a rectangular configuration. The housing 12 has an open front 14, a rear wall 16, a top wall 18, a bottom wall 20, two opposed side walls 22 and a hollow interior 24. The housing as a whole is built with the size of an amplifier of a stereo component. While not clearly illustrated in the Figures, it is preferred that the top wall and bottom wall of the housing extend beyond the side walls by about ⅛ of an inch for affording improved gripping when moving. The hollow interior 24 is divided into a front section 26 and a rear section 28. The rear section 28 has a shelf 30 disposed therein between the two opposed side walls 22 with a plurality of vertical dividers 31. The shelf 30 will hold a series of compact discs thereon. The housing 12 can be fabricated of either a wood material or a rigid plastic material. Ideally, the rear section has a depth of approximately 5 and ⅞ inches, a height of approximately 11 and ⅝inches, and a width of approximately 16 and ¼ inches.

The device 10 includes a pair of door compartments 34 including a right door compartment 36 and a left door compartment 38. Ideally, the compartments each have a depth of approximately 5 and ¼ inches, a height of approximately 11 and ½ inches, and a width of approximately 5 and ¾ inches. Each of the door compartments 34 include a front panel 40. The pair of door compartments 34 are hingedly secured within the open front 14 of the housing 12. The front panel 40 has a pair of windows 42 therethrough. The pair of windows 42 are dimensioned to fully display the front cover of a compact disk package. The pair of windows of the front panels each have a support frame 43 disposed adjacent thereto. The support frame 43 is used to hold compact discs therein to be displayed through the windows. The compact discs could be replaced by an illustration such as a guitar or other musical instrument. The front panel 40 of the left door compartment 38 has an interior panel 44 integral with an inner edge thereof. In a first embodiment shown in FIGS. 2, 4, & 6, the interior panel 44 has a pair of windows 46 therethrough. In a second embodiment, a picture may be printed on the outer surface of the interior panel 44, as shown in FIG. 1. Ideally, such picture takes the form of a guitar. The interior panel 44 further has a finger aperture 50 therethrough disposed below the windows 46 therethrough. In the second embodiment, such finger aperture preferably is positioned in the conventional opening of the guitar. Note FIG. 1. A lock 51 could also be incorporated into the door compartments 34.

Each of the door compartments 34 include a rear storage section 52. The rear storage section 52 is secured to an interior surface of the front panel 40. The rear storage section 52 includes an upper wall 54, a lower wall 56, a rear panel 57, and one side wall 58 thereby defining an open side face. As shown in the Figures, the rear panel of the right compartment is 1 inch less than that of the left compartment. Further provided is an intermediate shelf 60 disposed between the upper wall 54 and the lower wall 56. The intermediate shelf 60 is disposed between the pair of windows 42 on the front panel 40. The intermediate shelf 60 is used to hold approximately 11 compact discs thereon. The compact discs can be stacked on the intermediate shelf 60 whereby the front label of one of the compact discs can be seen through the window 42.

Figure 3:
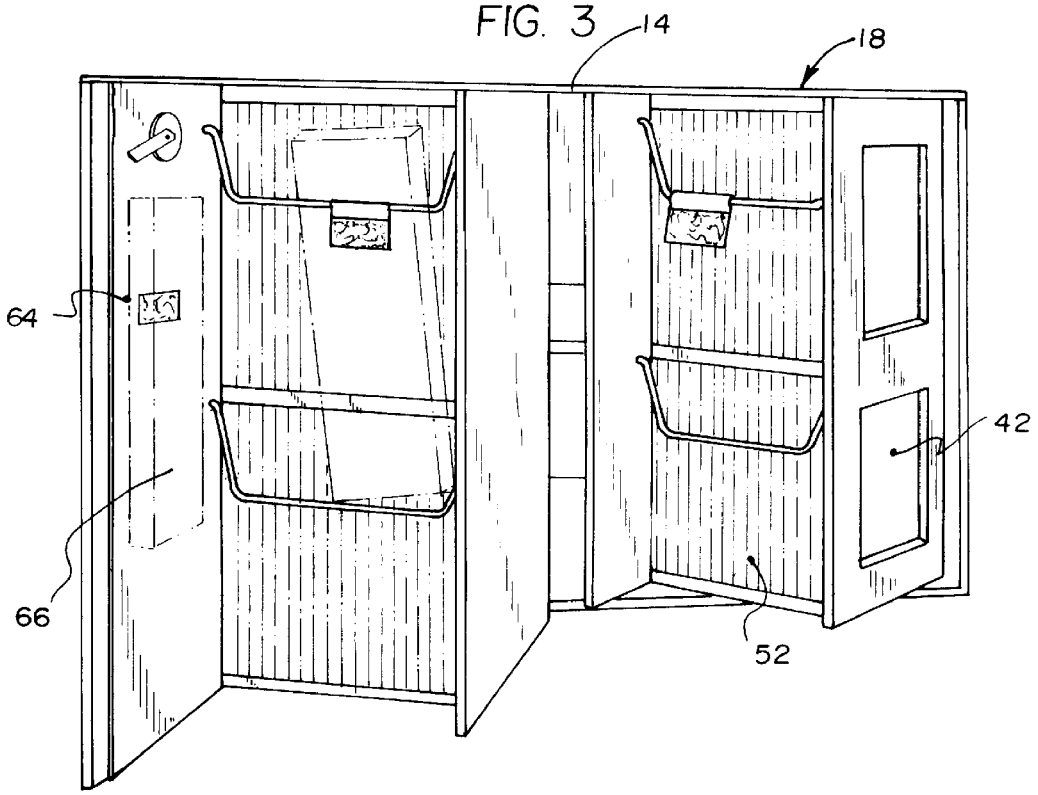
FIG. 3 is a front view of the present invention illustrated in an open orientation.
Figure 4:
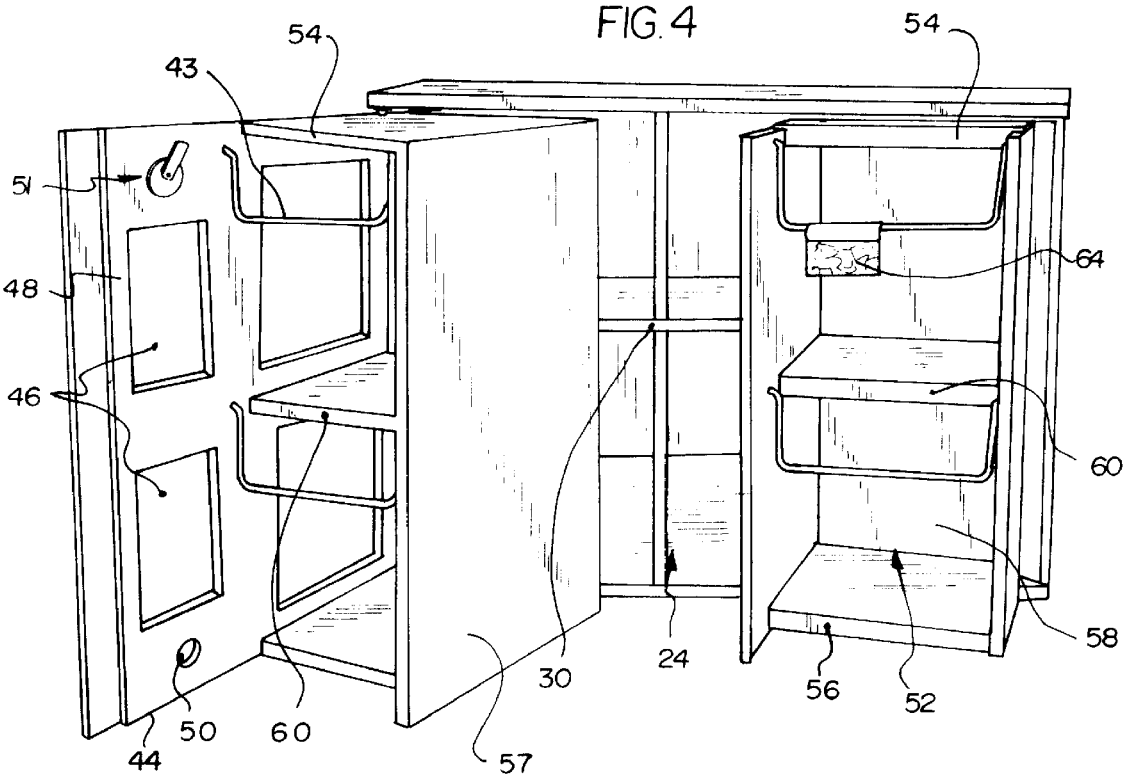
FIG. 4 is a front view of the alternate embodiment of the present invention illustrated in an open orientation.

For containment purposes, the open side faces each have a containment rod 43 situated both above and below the intermediate shelf of the rear storage section. The containment rods are adapted to contain the compact discs during storage. As best shown in FIGS. 3 & 4, the containment rods each having a U-shaped configuration and are pivotally coupled between the front and rear panel. By this structure, a lower horizontal portion of the containment rod may be pivoted upwardly to allow the insertion of compact discs within the associated rear storage section and subsequently dropped to contain the CD's. As shown in FIGS. 3 & 4, at least one of the containment rods has at least one hook and loop patch 64 secured thereto for attachment to the backs of remote control units 66. Each of the pair of door compartments 34 have a depth equal to a depth of the front section 26 of the hollow interior 24 of the housing 12.

Figure 5:
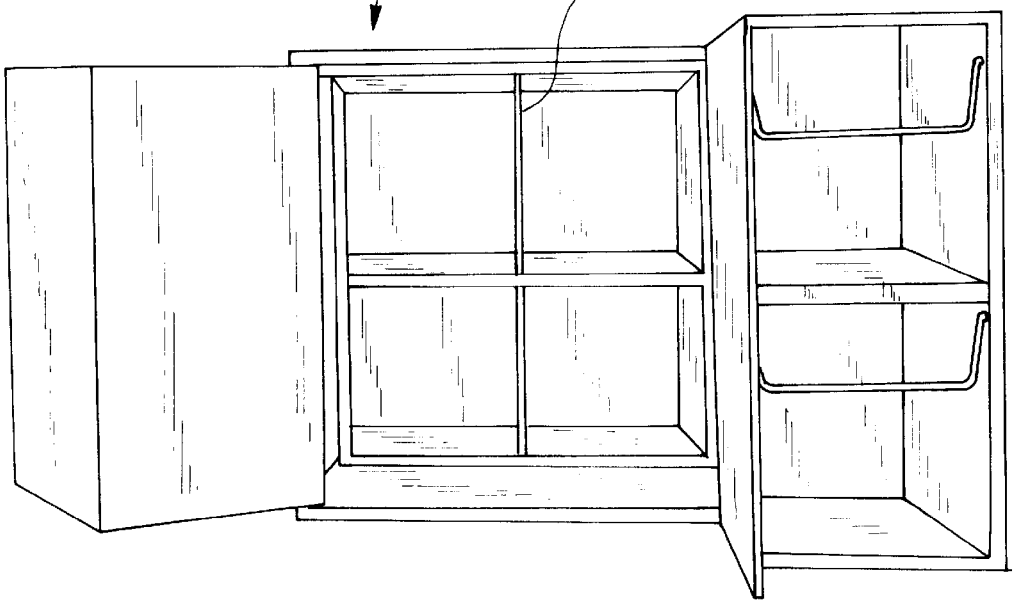
FIG. 5 is a front view of another embodiment of the present invention.
Figure 6:
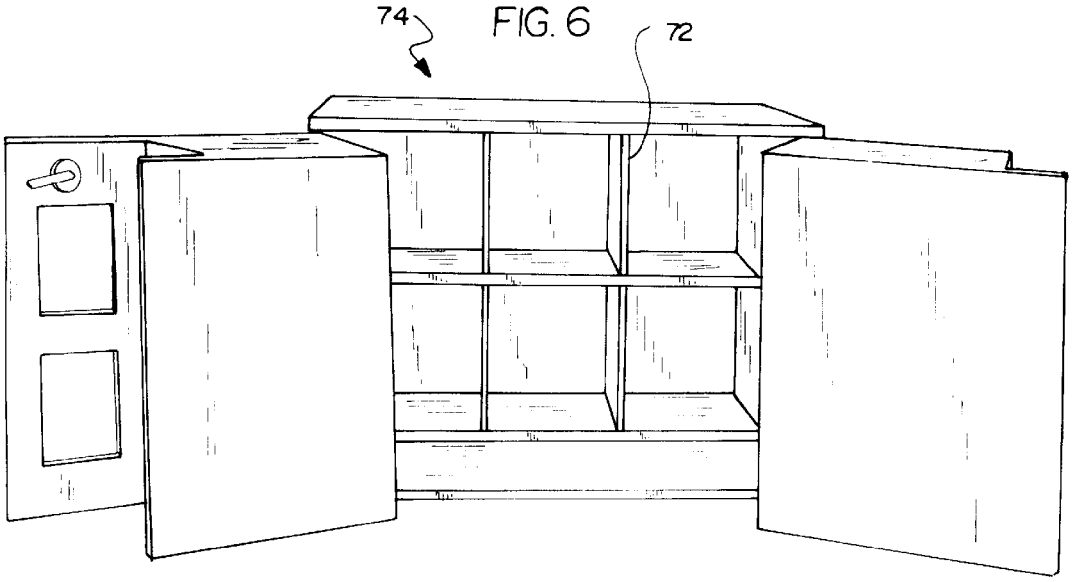
FIG. 6 is a front view of yet another embodiment of the present invention.

A third embodiment 70 of the present invention is shown in FIG. 5. In such embodiment, only one vertical divider 72 is situated in the rear section of the housing thereby defining 4 sub-compartments therein. The vertical divider bisects the intermediate shelf. With reference now to FIG. 6, a fourth embodiment 74 of the present invention is equipped with two vertical dividers 72 which are situated in the rear section of the housing thereby defining 6 sub-compartments therein. Each sub-compartment is preferably sized to contain 13 compact discs.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A cabinet for displaying and storing compact discs within an entertainment center comprising, in combination:

a housing having a rectangular configuration, the housing having an open front, a rear wall, a top wall, a bottom wall, two opposed side walls and a hollow interior, the top and bottom wall extending beyond the side walls, the hollow interior being divided into a front section and a rear section, the rear section having a shelf disposed therein between the two opposed side walls with a plurality of vertical dividers; and a pair of door compartments including a right door compartment and a left door compartment, each of the door compartments including a front panel, the pair of door compartments hingedly secured within the open front of the housing, the front panels each having a pair of windows therethrough, the front panel of the left door compartment having an interior panel integral with an inner edge thereof, the interior panel having a finger aperture therethrough disposed below windows formed therein, each of the door compartments including a rear storage section, the rear storage section secured to an interior surface of the front panel, the rear storage section including an upper wall, a lower wall, a rear panel, one side wall, and an intermediate shelf disposed between the upper wall and the lower wall thereby defining an open side face, the intermediate shelf being disposed between the pair of windows on the front panel, the open side face of each door compartment having a U-shaped containment rod pivotally coupled both above and below the intermediate shelf of the rear storage section, at least one containment rod having at least one hook and loop patch secured thereto, each of the pair of door compartments having a depth equal to a depth of the front section of the hollow interior of the housing.

* * * * *